United States Patent [19]

White

[11] 3,972,560

[45] Aug. 3, 1976

[54] CHAIR AND TABLE COMBINATION

[76] Inventor: Mayfield C. White, 201 W. 122nd St., New York, N.Y. 10040

[22] Filed: Dec. 18, 1974

[21] Appl. No.: 533,876

[52] U.S. Cl. ..... 297/145; 108/40; 297/217

[51] Int. Cl.[2] ..... A47B 83/02

[58] Field of Search ..... 297/145, 144, 147, 217, 297/194, 173; 108/48, 40, 38

[56] References Cited

UNITED STATES PATENTS

| | | | |
|---|---|---|---|
| 1,609,504 | 12/1926 | Wagner | 108/40 |
| 1,610,956 | 12/1926 | Lannom | 297/147 |
| 1,614,489 | 1/1927 | Nuesse | 108/40 |
| 1,907,322 | 5/1933 | Keicher | 297/145 |
| 2,257,425 | 9/1941 | Mezzetti | 297/147 |
| 2,741,300 | 4/1956 | Tubbs et al. | 297/145 |
| 2,767,771 | 10/1956 | Leonard | 297/145 |

*Primary Examiner*—Roy D. Frazier
*Assistant Examiner*—Darrell Marquette
*Attorney, Agent, or Firm*—Jacob L. Kollin

[57] ABSTRACT

An arm chair and folding table combination. The arm chair is provided with a back rest pivoted to the side walls of the chair. One of the side walls has an opening for receiving a folding table assembly. A U-shaped support is hinged to one end of the table top. The support has spaced legs into which the table top may be folded. A solid panel support is hinged to an opposite end of the table top. The entire table assembly is parallel with the plane of the side wall when folded.

2 Claims, 5 Drawing Figures

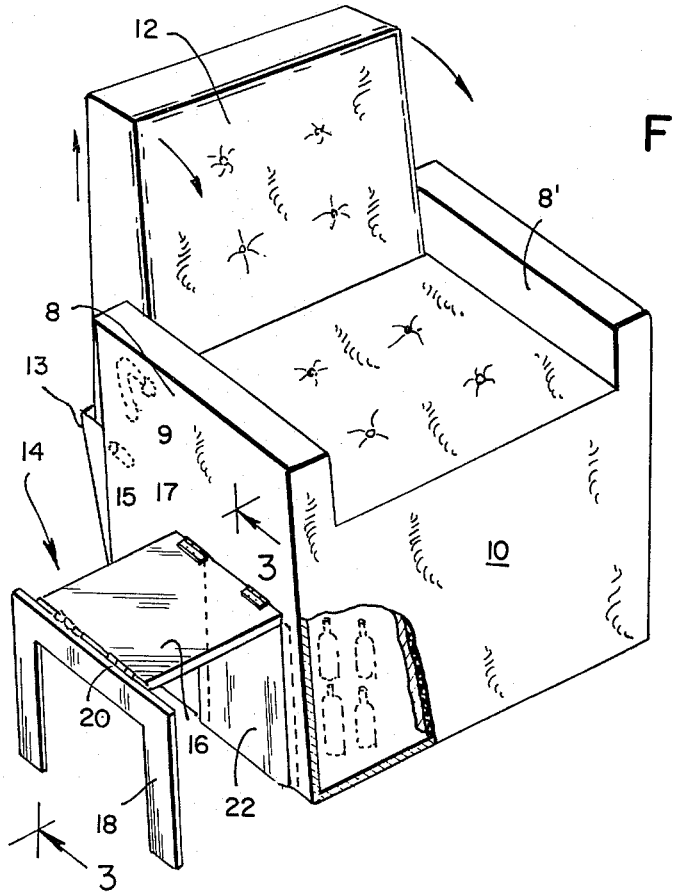
FIG. 1
FIG. 2
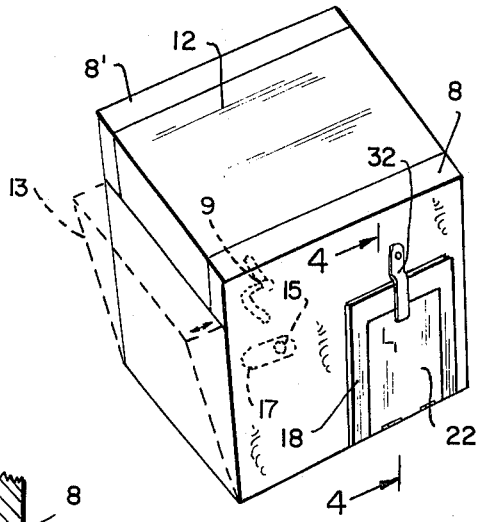
FIG. 3
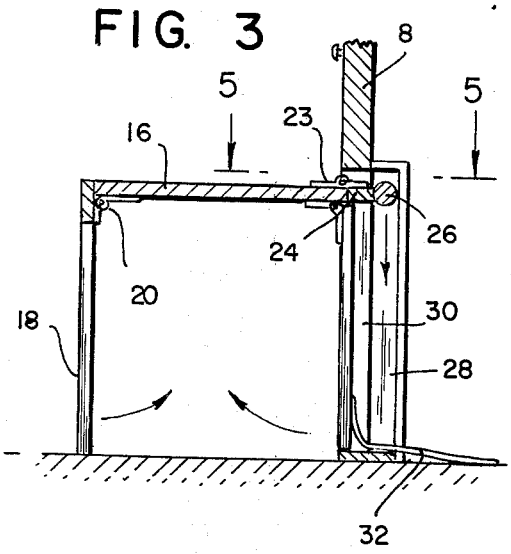
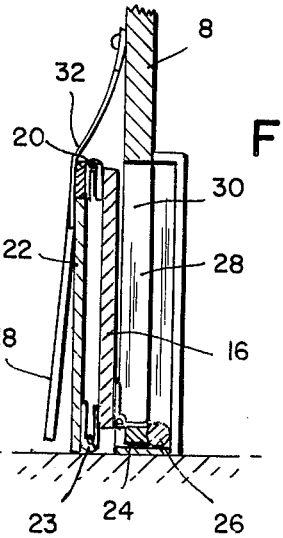
FIG. 4
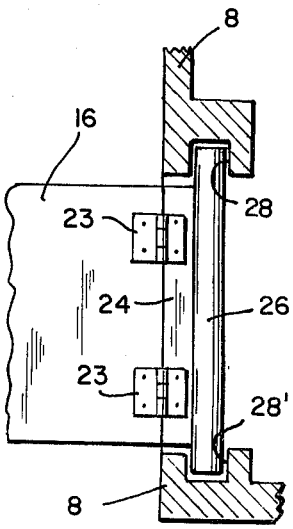
FIG. 5

CHAIR AND TABLE COMBINATION

The invention relates to chairs and particularly to a novel construction of a combination arm chair and table.

It is an object of the invention to provide such a combination comprising an arm chair having a foldable table hinged to one of its sides, said chair having a cut-out portion for receiving the folded chair.

Another object of the invention is to provide an arm chair having a foldable back rest, said rest being adapted to serve as an ironing board surface when folded.

A further object of the invention is to provide a chair having a tiltable back rest.

Still another object of the invention is to provide a device of the above character, which is reliable, simple and sturdy in construction and operation.

These and other objects of the invention will become apparent from the following description in connection with the appended drawing illustrating a preferred embodiment of the invention. It is to be understood, however, that these are given by way of illustration and not of limitation and that changes may be made in the detail construction, form and size of the parts, without affecting the scope of the invention sought to be protected.

IN THE DRAWING

FIG. 1 is a perspective view of the chair in unfolded position;

FIG. 2 is a perspective view of the chair in folded position;

FIG. 3 is a cross-section taken on line 3—3 of FIG. 1 and

FIG. 4 is a cross-section taken on line 4—4 of FIG. 2.

FIG. 5 is a cross-section taken on line 5—5 of FIG. 3.

Referring now to the drawing in detail, the chair according to the invention comprises a pair of side walls 8,8', a front wall 10, a swingable rear wall 13 provided with pins 15 slidable in slotted plates 9 and a back 12 pivoted at 17 to the side walls. These components may be upholstered in known manner, except that the rear panel of the back rest is rigid so that when it is folded as shown in FIG. 2 it may be used as a suitable surface for ironing. A folding table, generally indicated as 14 comprises a top 16 and a U-shaped leg 18 hinged at 20 to the top 16. A door 22 is hinged to the lower face of top 16. The door 22 is dimensioned to fit inside the U-shaped leg 18 when leg 18 and door 22 are folded together, as shown in FIG. 2.

Table top 16 is hinged at 23 to an extension 24 to which is secured a rod 26 slidable in channels 28, 28'.

To fold the table the door 22 and leg 18 and top 16 are folded together and allowed to slide, by means of rod 26 in the direction shown by the arrow in FIG. 3. The folded assembly is then pivoted upwardly to close the opening 30. A strap 32 attached to the side wall 8 is secured to the door 22.

The flat surface of the back rest can then be used as an ironing surface, when provided with appropriate padding, or for any other desired purpose.

When it is desired to use the combination as a chair and table, the panel 13 is tilted to the position shown by dotted lines in FIG. 2 and the chair unfolded, as shown in FIG. 1.

To fold the chair and the table, the back rest is closed, as shown, in FIG. 2 and the chair folded as shown in FIG. 4. The folded chair is kept in place by the latch 32.

I claim:

1. In combination, an arm chair and folding table, said chair comprising a pair of side walls, a rear wall and a front wall, a back rest pivoted to said side walls, one of said side walls having an opening therein, a folding table, means movably securing said table to said one side wall in said opening, said table comprising a table top, a U-shaped support hinged to one end of said table top, said U-shaped support having spaced legs into which said table top may be folded, a solid panel support hinged to an opposite end of said table top, means for positioning said table top, said U-shaped support and said panel support, when in folded condition, in alignment with said opening; said means for positioning comprising an extension member hinged to said opposite end of said table top, a horizontally extending rod secured to said extension member, a pair of vertically extending spaced channels positioned in said opening, and said rod being slidable in said channels.

2. The combination as claimed in claim 1, wherein said side walls are provided with slotted plates, said rear wall having end pins slidable in said slotted plates.

* * * * *